United States Patent [19]

Davies

[11] 4,203,261

[45] May 20, 1980

[54] ABRASIVE BELT MACHINING APPARATUS

[75] Inventor: David L. Davies, Cuiaba, Brazil

[73] Assignee: Tasco, Inc., Oak Ridge, Tenn.

[21] Appl. No.: 777,470

[22] Filed: Mar. 14, 1977

[51] Int. Cl.[2] ..... B24B 21/02

[52] U.S. Cl. ..... 51/141; 51/145 R

[58] Field of Search ..... 51/141, 144, 145, 142

[56] References Cited

U.S. PATENT DOCUMENTS

| | | | |
|---|---|---|---|
| 1,528,188 | 3/1925 | Frost | 51/103 C X |
| 2,057,290 | 10/1936 | Bradbury | 51/144 |
| 2,817,930 | 12/1957 | Dayton | 51/141 X |
| 2,934,864 | 5/1960 | Karbowski | 51/141 |
| 3,157,968 | 11/1964 | Kurtz | 51/145 R |
| 3,537,831 | 10/1968 | Foster | 51/145 R |
| 3,650,073 | 3/1972 | Weisman | 51/141 |
| 3,969,848 | 7/1976 | DeMusis | 51/141 |

FOREIGN PATENT DOCUMENTS

| | | | |
|---|---|---|---|
| 499096 | 11/1971 | U.S.S.R. | 51/144 |

*Primary Examiner*—Nicholas P. Godici

*Attorney, Agent, or Firm*—Pitts & Kesterson

[57] ABSTRACT

An abrasive belt apparatus for machining a workpiece to produce a preselected contour and finish comprising means for positioning the workpiece along a predetermined axis during machining operations. An endless abrasive belt is disposed in a plane substantially aligned with the axis of the workpiece and driven by suitable drive means. The belt is trained about contoured contact means disposed proximate a section of the workpiece and movable along an axis substantially perpendicular to the axis of the workpiece to bring the abrasive surface of the belt into contact with the workpiece for removing stock to produce a desired contour and finish upon actuation of the belt. The direction in which the belt is driven at its location of contact with the workpiece produces a finish having marks which run substantially longitudinally of the workpiece. Means are provided for selectively rotating the workpiece during machining operations to produce a workpiece having a substantially circular outline. A method for machining a workpiece to produce a preselected contour and finish is also disclosed.

17 Claims, 8 Drawing Figures

ABRASIVE BELT MACHINING APPARATUS

This invention relates to an abrasive belt apparatus and more particularly concerns an abrasive belt apparatus adapted for shaping and finishing a workpiece.

In certain mechanical and testing operations, shaped metal members having preselected contours and finishes are required. In order to remove metal from a section of metal stock being worked on, i.e., a workpiece, to produce the desired preselected contours and finishes a variety of machine tools and processes are used; however, such machining operations normally require a highly skilled machinist and are attended by substantial waste which combine to increase the production cost of the shaped metal members.

One of the most widely used machine tools for shaping a metal workpiece is a lathe which serves to rotate the workpiece about a substantially horizontal axis during cutting operations normally performed by a fixed cutting edge. In certain types of high precision work such as machining metallurgical specimens to specified tolerances, for example, the machinist applies pressure on the workpiece in the direction of the cutting edge to the end that the desired amount of stock is cut from the workpiece. In this connection, the pressure applied to the workpiece must be varied in order to accomodate dulling of the cutting tool occasioned during machining operations. If the adjusted pressure applied to the workpiece over compensates for the degree of tool dulling, the specimen will be wasted by removal of too much stock. Thence the process must be repeated on a fresh workpiece with no assurance of more favorable results. Moreover, much waste may attend the machining of precision symmetric contours on a single workpiece and contours which are substantially identical on a plurality of workpieces fabricated from various metal stocks on machine tools presently known to be available. Further, conventional machines which cut stock from a rotating workpiece with a tool edge positioned substantially perpendicular to the axis workpieces produced circumferential marks on the finish which are undesirable in certain applications such as testing of metallurgical specimens.

Accordingly, it is an object of this invention to provide an improved apparatus adapted for shaping and finishing a workpiece. Another object of the invention is to provide an improved method for producing a workpiece having a preselected contour and finish. A further object of this invention is to provide a method and apparatus for abrasive belt machining which produces substantially longitudinal marks on the contoured surface. Other objects and advantages of the invention will become apparent from the following detailed description taken in connection with the accompanying drawings wherein like numerals refer to like parts and in which:

Figure 1:
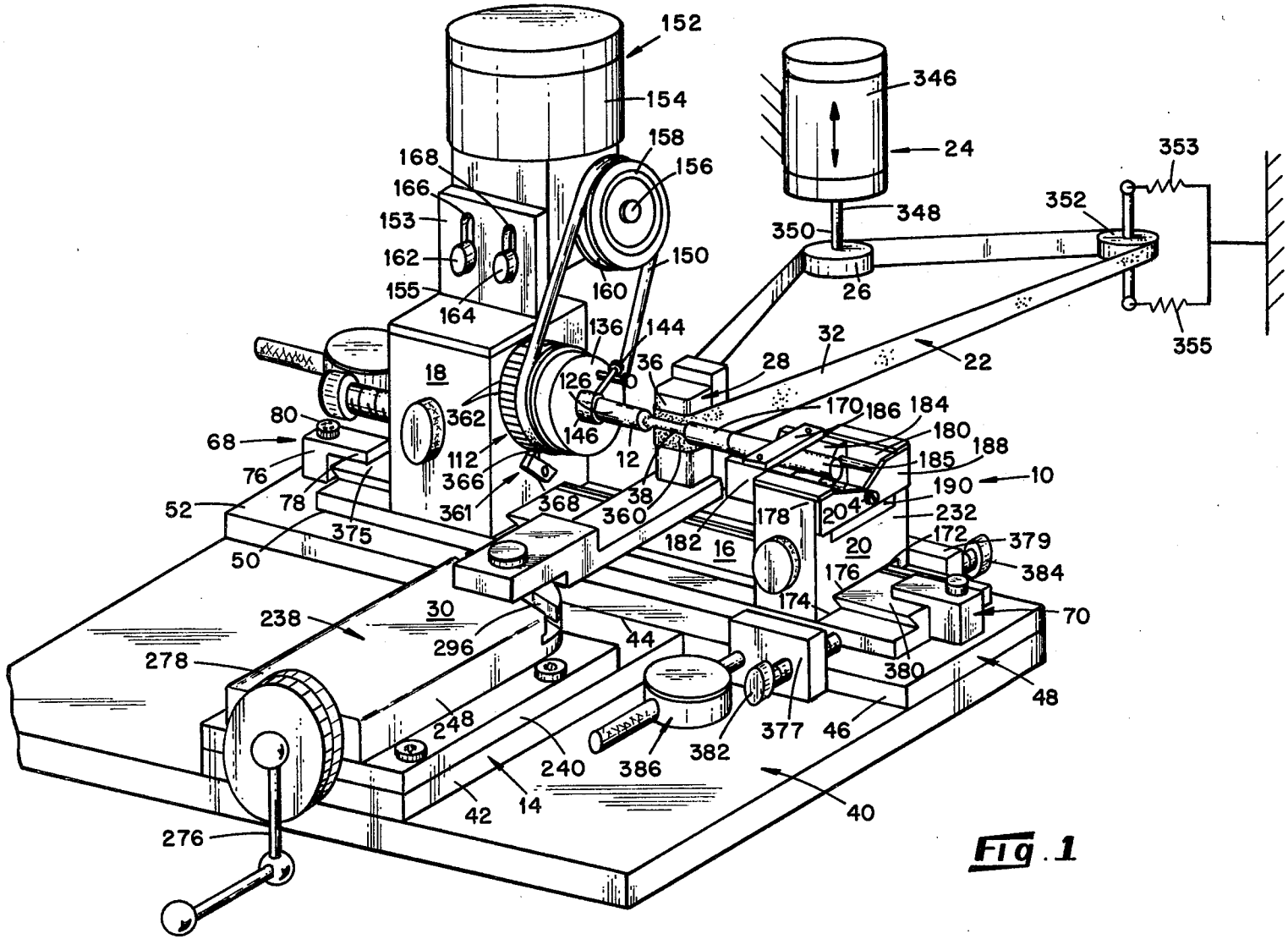
FIG. 1 is a perspective view of an abrasive belt apparatus embodying various features of the invention.

In accordance with the detailed description, an abrasive belt apparatus generally indicated at 10 is provided for machining a workpiece 12 to produce a preselected contour and finish. To this end, the apparatus 10 includes frame 14 supporting a lathe way 16 having a headstock 18 and tailstock 20 slidably mounted on the way 16 and carrying opposed centers 17 and 19, respectively, which may be mounted in dowel rods for example and which supportably engage opposite ends of the workpiece 12 to position it along a predetermined axis during machining operations. An endless abrasive belt 22 is disposed in a plane substantially aligned with the axis of the workpiece and driven by drive means 24 through driving pulley 26. A section of the belt 22 is trained about contact means 28 disposed proximate a section of the workpiece and movable along an axis substantially perpendicular to the axis of the workpiece by a lathe compound assembly 30 to bring the abrasive surface 32 of the belt into contact with the workpiece to produce a desired contour and finish upon driving of the belt. The direction in which the belt is driven at its location of contact with the workpiece produces a finish having marks which run substantially longitudinally of the workpiece. To produce contoured surfaces having substantially circular cross section, further drive means 34 serve to rotate the workpiece at a preselected speed during machining operations.

The method of the present invention generally includes positioning the workpiece 12 along a predetermined axis. A portion of a motor driven abrasive belt 22 is guided along a predetermined path by contact means 28 positioned proximate the workpiece and contoured to produce a preselected contour in the workpiece upon movement of the abrasive belt 22 into contact therewith. The workpiece and the section of the abrasive belt 22 trained about the contoured surface 36 of the contact means 28 are then brought into contact for removing stock from the workpiece to produce a desired contour and finish.

To assist in producing a workpiece 12 having substantially circular outline along its contoured section or guage length 38, the workpiece is rotated during the machining operations. In this connection, the rotational speed of the workpiece may be adjusted for producing finishing marks which have a slight helical pitch, for example, and extended substantially longitudinally of the workpiece.

The apparatus 10 shown in FIG. 1 is adapted for carrying out the method of the invention and finds particular application in assisting a semi-skilled machinist in the production of high precision work such as metallurgical specimens utilized in testing various properties of the metals and alloys from which the specimens are fabricated. More specifically, the illustrated abrasive belt apparatus 10 is adapted for being positioned on a suitable surface 40 and includes a frame generally indicated at 14 which carries the various elements of the apparatus. In this connection, the frame 14 in the illustrated embodiment is fabricated from a suitable rigid material such as steel and includes a substantially rectangular plate 42 which is joined along its edge 44 to a portion of side edge 46 of a further rectangular plate 48 positioned substantially perpendicular to plate 42 forming a "T" shaped frame geometry.

Figures 4, 5:
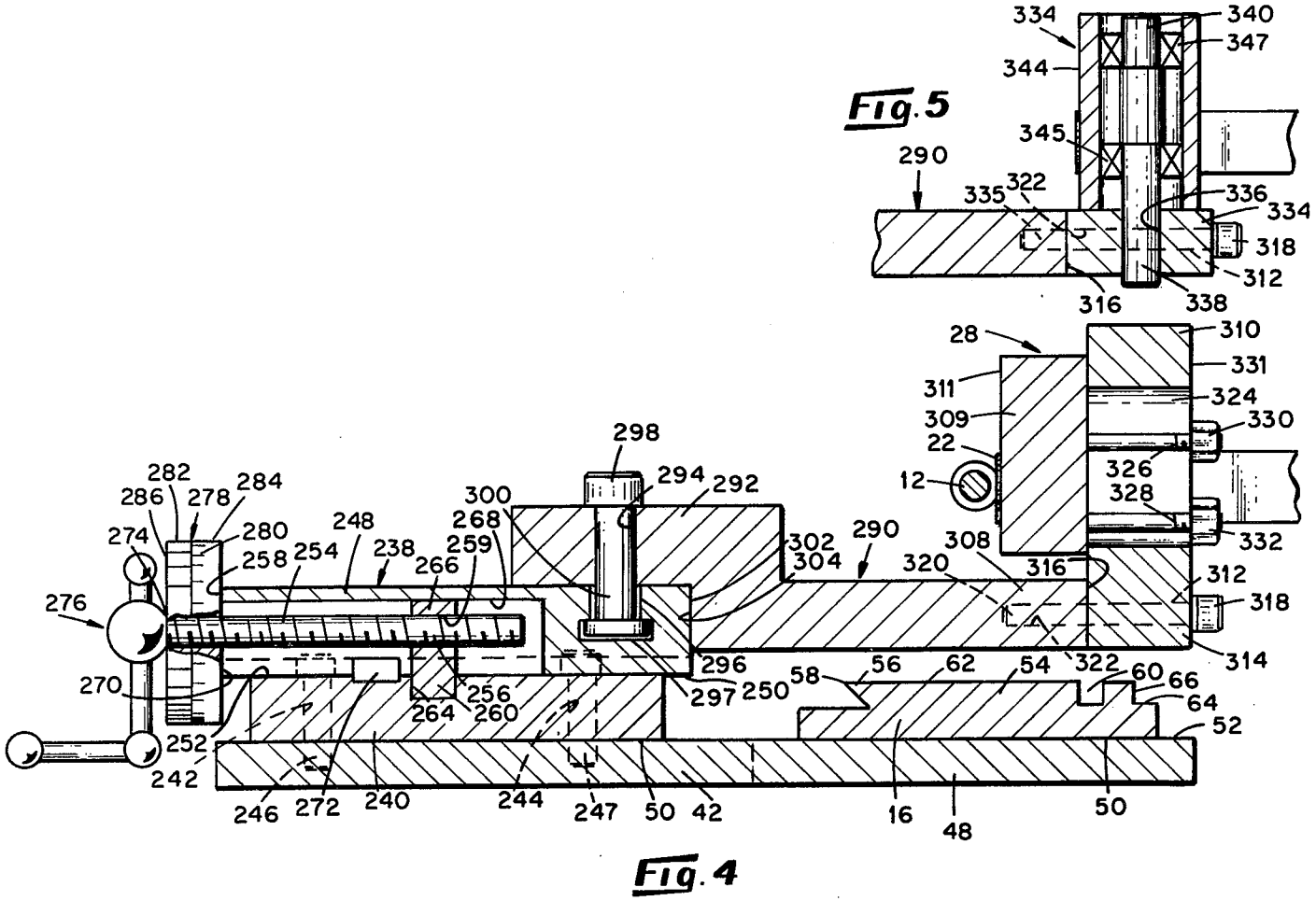
FIG. 4 is a sectional side elevational view taken along line 4—4 of FIG. 2.
FIG. 5 is a sectional side elevation view of alternative contact means used to bring the abrasive belt into contact with the workpiece, with a portion of the apparatus broken away.

To assist in positioning workpiece 12 along a predetermined axis during machining operation, an elongated way 16 is provided. Illustrated way 16 is fabricated from a suitable rigid material and is supported along its lower surface 50 by upper surface 52 of plate 48. As shown in FIG. 4, upper section 54 of way 16 includes a dove tailed portion 56 along its edge 58 and defines a substantially rectangular groove 60 opening on upper surface 62 of the way. The upper section 54 is recessed along its opposite edge 64 to define a substantially vertical surface 66 which cooperates with the dove tailed portion 56 to guide a suitable headstock 18 and tailstock 20 along the way 16 as will be more fully described hereinafter.

In order to position the way at predetermined locations during machining operations, means are provided for securing the way to the frame plate 48. In the illustrated embodiment, the means for securing the way to the frame comprise a pair of tie downs 68 and 70 which are positioned at opposite ends of the way 16 adjacent edges 72 and 74, respectively, and bolted to the frame 14. Tie downs 68 and 70 are substantially identical in construction and a description of one of the tie downs will suffice for a description for each of the tie downs. Tie down 68 includes a substantially rectangular body section 76 integrally formed with a cantilevered arm 78 which engages the upper surface 62 of the way 16 and serves to secure the way 16 to the frame plate 48 upon bolting the tie down 68 to plate 48 by bolt 80.

Headstock 18 is substantially rectangular in configuration and slidably mounted on lathe way 16 for positioning the workpiece 12 at a predetermined location along the axis of its movement. To this end, the headstock 18 is provided with a channel 82 opening on its lower surface 84 and which is complimentary in shape with and adapted for receiving the upper section 54 of the lathe way 16. In this connection, section 86 of the channel 82 is dovetailed and serves to receive the dovetailed section 56 of the way 16 to assist in preventing vertical movement, the headstock 18 with respect to the way.

In order to selectively move the headstock 18 along the length of the way 16, a headstock positioning screw 88 (See FIG. 2) is threadably received along a portion of its length in a bore 90 provided in block 92 bolted to the frame plate 48 by bolt 94. End 96 of screw 88 engages surface 98 of the headstock 18 to the end that threadably advancing screw 88 in aperture 90 moves the headstock 18 longitudinally along way 16 toward the tailstock 20.

To move the headstock 18 away from the tailstock 20, screw 88 is rotated to withdraw the screw from the block aperture 90. In this connection, end 96 of screw 88 is provided with a section 100 of increased cross section which is received in a slotted bracket 12 secured to surface 98 of headstock 18. This section 100 engages the portions of the bracket 102 adjacent slot 104 upon withdrawing screw 88 from aperture 90 for moving the headstock 18 toward edge 72 of the way 16. As necessary or desired, block 92 can be positioned adjacent terminal edge 72 of the way and the shaft of screw 88 lengthened to assist in moving the headstock 18 greater distances along the way.

For high precision work it is desirable to know the position of the workpiece along its axis of movement within a small fraction of inch. To this end, a dial micrometer 106 of conventional design is mounted on block 92 adjacent end edge 72 of the way 16 and includes a spring biased plunger 108 which abuts surface 98 of the headstock 18 at its end for sensing the headstock position. The position of the headstock 18 relative to block 94 can be read on dial 110.

A headstock assembly 112 is provided to assist in supporting and rotating the workpiece 12 during sanding operations. In this connection, an elongated dowel rod 115 is received in a horizontal bore 116 which opens on faces 98 and 118 of the headstock and maintains the dowel rod 115 in a position substantially aligned with the longitudinal axis of the workpiece 12. The dowel rod 115 is secured in the bore 116 by a suitable set screw 117 received in internally threaded bore 119 which opens at its end 121 into bore 116. End portion 122 of dowel rod 115 extends substantially perpendicularly from face 118 of headstock 18 and is provided with a bore 120 opening on end surface 121 of the dowel rod 115. A suitable wear resistant center 17 is received in bore 120 and secured by a set screw 123 which serves to prevent rotation of the center 17. The center 17 is disposed substantially along the longitudinal axis of a workpiece and defines a tip 124 which is complementary in shape with end 126 of workpiece 12 to the end that the center 12 supports the workpiece 12 during machining operations. More specifically, tip 124 is adapted for mating with a suitable recess (not shown) on the end 126 of the workpiece 12.

Figure 3A:
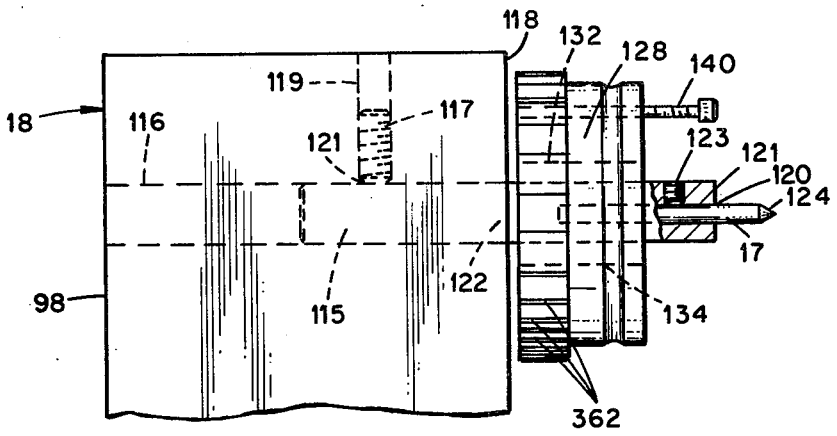
FIGS. 3A and 3B are partial sectional views of a part of the apparatus taken along lines 3A—3A and 3B—3B, respectively of FIG. 1.

A spindle 128 serves to assist in rotating the workpiece 12 during machining operations in which it is desired for the guage length of the workpiece 12 to be circular in cross-section. In this connection the spindle 128 is rotatably mounted on end portion 122 of dowell rod 115 through bearing 132 which is received in bore 134 of spindle 128, and which engages the dowel rod 115 (See FIG. 3A).

In order to rotate the workpiece 12, a post 140 is secured to the spindle 128 in a cantilevered fashion and engages post 144 of lathe dog 146 which imparts motion to the workpiece 12 upon rotation of the spindle 128.

To assist in selectively driving spindle 128 during machining operation, spindle 128 defines a circumferential groove 148 substantially about its midportion in the illustrated embodiment which is adapted for receiving a section of a circular drive belt 150 trained about the spindle. Belt 150 is driven by suitable drive means 152 comprising a variable speed motor 154 in the illustrated embodiment mounted on a suitable upright support frame member 153 secured along its lower edge 155 to the top surface of headstock 18. Motor 154 drives shaft 156 which carries a drive pulley 158 defining a circumferential groove 160 about which belt 150 is trained.

In order to maintain the desired tension in belt 150, the vertical position motor 154 is adjustable. To this end, motor 154 is mounted on frame member 153 by bolts 162 and 164 which are received in elongated frame slots 166 and 168, respectively.

Tailstock 20 is substantially rectangular in configuration and serves to support end 170 of the workpiece 12, for positioning it along a predetermined axis. Moreover, the workpiece can be moved longitudinally along this axis by moving the tailstock 20 and headstock to predetermined positions on the way. More specifically, tailstock 20 is provided with a channel 172 opening on lower surface 174 of the tailstock 18 which is complementary in shape with and adapted for receiving the upper section 54 of the lathe way 16. Section 176 of the channel 172 is dovetailed and receives the dovetailed portion 56 of the way 16 to assist in preventing vertical movement of the headstock 18.

In the illustrated embodiment, workpieces can be readily inserted into the apparatus 10 and positioned along a predetermined axis during machining operations. To this end, center 19 engaging end 170 of the workpiece 12 is movable along an axis substantially identical to the axis upon which a workpiece is positioned. In this connection, the upper portion 178 of the tailstock 20 is provided with a substantially rectangular channel 180 having a longitudinal axis which is substantially aligned with the axis along which the workpiece 12 is movable. A substantially rectangular carriage 182 defining a "V" shaped channel 184 is slidably mounted in the tailstock channel 180 with a precision fit to assist in preventing the carriage from wobbling during machining operations. The "V" shaped channel 184 is adapted for receiving center 19 which is mounted therein by bar 186 which is secured at its opposite ends to the opposite sides of the carriage and engages the center 19 for maintaining it in a fixed position.

Carriage 182 is spring biased toward juxtapositioned center 17 to facilitate removal and insertion of a workpiece. To this end, a bar 188 is secured across end 190 of channel 180 and supports cantilevered rods 192 and 194 (See FIGS. 2 and 4) which are disposed substantially parallel with the longitudinal axis of channel 180 and telescopically received in bores 196 opening on rear surface 200 of carriage 182. The outboard end of rods 192 and 194 are acted upon by springs 202 disposed in bores 196 for purposes of biasing carriage 183 and center 19 secured in channel 184 toward center 17 for supporting the opposite ends of the workpiece. When it is desired to remove a workpiece from the apparatus, carriage 182 is moved in channel 180 toward bar 188 which disengages center 19 and the end 170 of the workpiece which enables its removal. Bar 188 is provided with a "V" shaped groove to allow end 185 of the center to slide past the bar upon retraction of the carriage.

Outward movement of carriage 182 is terminated by a suitable stop comprising screw 204 (see FIG. 2) in the illustrated embodiment which is slidably received in a suitable aperture (not shown) in bar 188 and which is secured at its end 206 in a suitable bore opening on surface 200 of carriage 182. Vertical movement of the carriage 182 is prevented by facing bars 208 and 210 secured along their length to the upper surface of tailstock 20 and which include facing edges engaging the marginal side portions of the upper surface 212 of carriage 182.

Figure 3B:
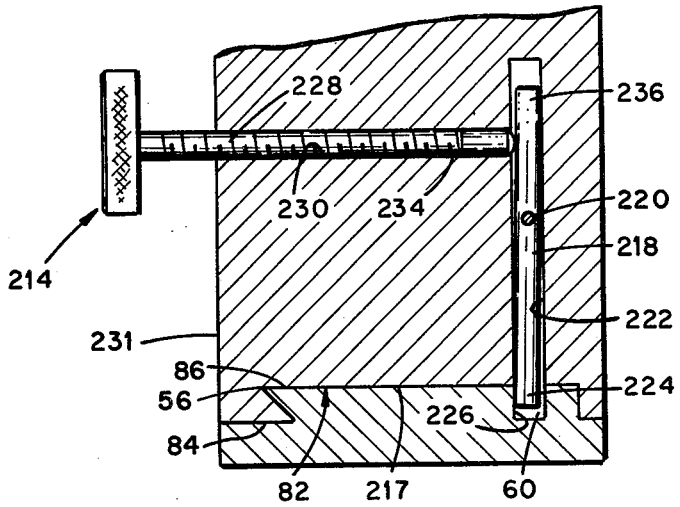

Upon movement of the headstock 18 and tailstock 200 to a desired position on the way 16, these members are locked into position for supporting the workpiece during machining operations. To this end, suitable locking means are provided on the headstock 18 and tailstock 20. The illustrated locking means provided on the headstock 18 and tailstock 20 are substantially identical and for this reason, a description of the locking means 214 provided on the headstock 18 will suffice for a description of the tailstock locking means 216. The locking means 214 (see FIG. 3B) includes a substantially upright member 218 pivotally mounted about pin 220 in bore 222 opening on surface 217 of channel 82. End 224 of member 218 is slidably received in the substantially rectangular groove 60 and pivotable about pin 220 for engaging surface 226 of the groove 60 upon movement of the block to a desired position. In this connection, locking screw 228 is threadably received in bore 230 defined in headstock 20 and opening on headstock surface 231. End 234 of screw 228 engages end 236 member 218 and serves to rotate member 218 upon advancing screw 228 into bore 230 such that lower end 224 engages surface 226 of groove 60 to lock the block into position. When it is desired to move the block to a different position along the way, screw 228 is threadably withdrawn from the internally threaded bore 230 and the end 236 of member 218 is disengaged by the end 234 of the screw allowing end 224 of the pivoted member 218 to move to a substantially vertical position for movement along the groove 60 upon longitudinal movement of headstock 18 along way 16.

The workpiece 12 is machined for proucing a preselected contour and finish by selectively moving a section of the abrasive belt 22 trained about a predetermined contoured surface defined by suitable contact means into contact with the workpiece. In this connection, a lathe type compound assembly 30 is provided for supporting and moving the contact means 28 along a predetermined axis substantially perpendicular to the longitudinal axis of the workpiece. The lathe compound assembly 30 in the illustrated embodiment includes a lathe compound 238 having a substantially rectangular lower section or base 240 provided with spaced apart pairs of bores 242 and 244 adapted for receiving bolts 246 and 247, respectively, to secure the lathe compound 238 to the frame plate 42.

The upper section 248 of the lathe compound is substantially rectangular in configuration and slidably mounted along its lower surface 250 on the upper surface 252 of the base 240 of the lathe compound. In this connection, the upper section 248 of the lathe compound is provided with an elongated lead screw 254 received in a bore 256 extending substantially along the longitudinal axis of the lathe compound and opening on end surface 258 of the upper section 248 (See FIG. 4).

Section 256 of the lead screw 254 is threadably received in an internally threaded aperture 259 defined by member 260 which is disposed substantially perpendicularly to the axis of screw 254 and fixedly secured at its lower end in bore 264 opening on the upper surface 252 of the lathe compound 238. The upper section 266 of member 260 is slidably received in elongated channel 268 to permit movement of the upper section 248 of lathe compound with respect to the lower section 240.

The upper section 248 of the lathe compound is guided along a path substantially perpendicular to the longitudinal axis of the workpiece 12 by slot 270 which slidably received key 272 during movement of this section of the lathe compound 30.

To facilitate movement of upper section 248 across the base 240 of the lathe compound, end 274 of lead screw 254 is provided with a conventional lathe handle 276 adapted for being gripped by an operator for rotation of screw 254. More specifically, rotation of lead screw 254 slidably moves the upper section 248 of the lathe compound across the upper surface 252 of the base or base section 240, with the degree and direction of movement being determined by the amount and direction of rotation of the lead screw.

The distance the upper section 248 of the lathe compound 230 moves with respect to the fixed lower or base section 240 is indicated by a lathe dial 278 includes a substantially circular section 280 secured at the end surface 258 of the upper section 248. A cooperating dial portion 282 is secured to the end 274 of the lead screw 254 and rotates with respect to the dial portion 282. Dial portions 280 and 282 are provided with circumferential scales 284 and 286, respectively, which are etched along the perimeter of each of these sections to indicate the position of the upper section 248. As will be more clearly pointed out hereinafter, the depth of stock removed from a rotating workpiece during machining operations will be twice the amount of movement of the upper section 248 as indicated on dial 278 after the abrasive belt is moved into contact with the workpiece 12.

The lathe compound 238 is disposed adjacent the forward portion of the frame 14 in the illustrated embodiment of facilitate operation of the handle 276 while viewing the machining operations from a desired vantage point. In this connection, movement of the upper section 248 of the lathe compound is imparted to the contact means 28 through a suitable connecting arm 290 which serves to support the contact means 28. In the illustrated embodiment, connecting arm 290 is "z" shaped and provided at its end 292 with a bore 294 which registers with a bore 296 having a "T" shaped lower section 297 provided in the upper section 248 of the lathe compound. The arm 290 is secured to the lathe compound 238 by a "T" bolt 298 which extends through bore 294 and is received at its end 300 in bore section 297 of the upper section 248 of the lathe compound. In the illustrated embodiment, bores 294 and 296 in the arm 290 and upper section 248 of the lathe compound, respectively, are positioned so that the leading edge 302 of the upper section 248 engages the substantially vertical portion 304 of the arm 290 to assist in preventing pivoting of the arm with respect to the lathe compound. As necessary or desired, pivotal movement of arm 290 can also be prevented by using a pair of bolts for securing it to upper section 298, for example.

A preselected contour and finish is produced on the workpiece 12 by driving an endless abrasive belt 22 along a predetermined path by contact means 28 selectively movable along an axis substantially perpendicular with the longitudinal axis of the workpiece for bringing the section of the belt trained thereabout into contact with the workpiece 12. In the illustrated embodiments, the contact means which serve to guide the working section 306 of the belt along a predetemined path are supported at the outboard end 308 of the connecting arm 290 by suitable mounting means described in more detail hereinafter. One suitable contact means comprises an elongated contoured block 309 (See FIG. 4) fabricated from suitable hardened steel. The contoured face 311 of the block 309 is precision ground by a skilled metal worker to a geometry adapted for guiding the abrasive belt 22 along a predetermined path. In the illustrated embodiment, the contoured face 311 is elongated to the end that the vertical position of the contour block 309 can be adjusted as will be described in more detail hereinafter, for exposing a fresh section of contoured face 311 to the belt 22 after prolonged usage of a section of the contoured block 309 for guiding the belt 22 alters the shape of the corresponding face 311.

Figure 2:
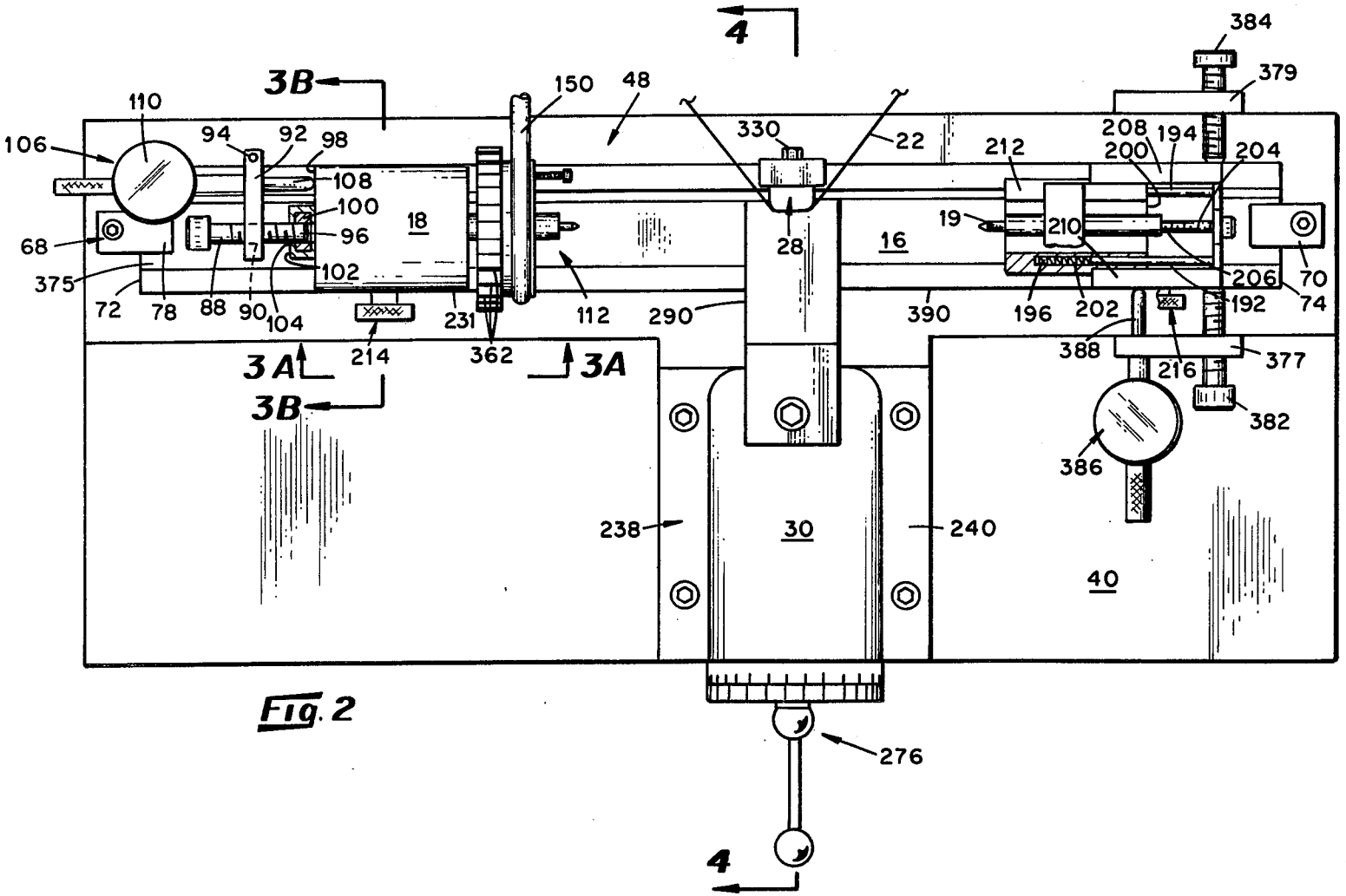
FIG. 2 is a plan view of the apparatus shown in FIG. 1 with a portion of the apparatus broken away for illustrative purposes.

Mounting means adapted for supporting contoured block 309 are shown in FIG. 1, 2 and 4 and comprise an elongated mounting block 310 defining spaced apart bores 312 at its end 314 secured to the end surface 316 of the arm 290 by suitable bolts 318 received at their ends 320 in bores 322 opening on arm end surface 316. In order to secure the contoured block 309 to the mounting block 310, an elongated slot 324 is provided substantially along the longitudinal axis of the block 310 and is adapted for receiving bolts 326 and 328 therethrough, the end portions (not shown) of these bolts being received in suitable bores provided in the contoured block 309. In order to prevent the head portions 330 and 332 of the bolts 326 and 328 from passing through the elongated slot 324, the slot width is proportioned so that the bolt heads engage surface 331 of the block 310 upon advancing the end portions of the bolts into the contoured block 309 or alternatively suitable washers may be used as necessary or desired.

In certain machining operations, it is desirable to impart an arcuate or semi-circular contour to a workpiece. To this end, arcuate contact means 334 (See FIG. 5) may be provided for guiding the abrasive belt 322 during machining operations. In this connection, a substantially rectangular mounting block 334 is provided with spaced apart bores 322 which register with similarly spaced bores 335, for example, which open onto the end surface 316 of the connecting arm 290. A transverse bore 336 is provided substantially centerally of the mounting block 334 and adapted for receiving the end portion 338 of shaft 340 secured in bore 336 by a set screw (not shown), for example. In the illustrated embodiment, contact means 334 is rotatably supported or the shaft 340 by bearings 345 and 347 mounted at spaced locations along the length of shaft 340. The accurate outer surface of the contact means 334 serves to guide the working section of the belt along a predetermined path.

It will be recognized that end surface 316 of the connecting arm 290 serves as a reference surface which assists in positioning freshly ground contact means at their respective original positions, after continued usage of the contact means necessitates removal for purposes of regrinding, for example.

The endless belt 22 is disposed in a plane substantially aligned with the longitudinal axis of the workpiece 12 and driven along its section 360, i.e., the working section, which contacts the workpiece along a predetermined path which produces substantially longitudinal marks on the contoured surface of workpiece, such longitudinal marks being particularly desirable in certain specimens used in metallurgical testing. Moreover, the abrasive surface of the belt 22 can be changed to produce the desired finish on the workpiece by varying the coarseness of the grit. In this connection, belts having different grits normally varying from rough to fine may be sequentially substituted during the machining of a workpiece to produce a desired finish.

In order to drive the endless belt 22 over the contoured surface 36 of the contact means 28 during machining operations, suitable drive means 24 are provided. The drive means illustrated in FIG. 1 comprises a motor 346 of conventional design and adapted for rotatably driving drive shaft 348 carrying driving pulley 26 on its outboard end 350. Drive pulley 26 engages the inner surface of the endless belt 22 and serves to rotate the belt 22 upon actuation of the motor 346.

In the preferred embodiment, motor 346 is a variable speed electric motor having an adjustable vertical position adapted for driving the substantially horizontally disposed belt 22 in a desired plane to the end that the belt passes over a predetermined portion of the contact means 28. In this connection, the position of the belt 22 trained about contact means 28 can be adjusted for exposing fresh sections of the belt 22 to the workpiece, as may be necessary or desired after prolonged usage of the belt deleteriously affects its abrasive surface. Moreover, over, as necessary or desired the vertical position of contact means 28 may be adjusted by the bolts 326 and 328 to position a freshly ground portion of the surface 311 in contact with the belt 22 (See FIGS. 1 and 4).

Tension in the belt 22 is maintained in the illustrated embodiment by a suitable idler wheel 352 which engages the inner surface of the belt 22 at a location spaced from the drive wheel 26. The idler wheel 352 is preferably spring biased toward the belt with the tension on the springs 353 and 355 illustrated diagrammatically in FIG. 1 being adjustable for varying the belt tension. Adjusting the tension in the belt 22 assists in controlling flopping of the belt away from the contoured surface 36 which may result in undesirably altering the guage length contour of a workpiece.

In certain machine operations, it is desired that the workpiece 12 be rotatably indexed to predetermine rotational positions prior to the removal of stock from the workpiece by the abrasive belt 22. Such indexing finds particular application where it is desired to produce the workpiece having a guage length cross section with a plurality of flat sides. In this connection, indexing means generally indicated at 361 (see FIG. 1) are provided and comprise a plurality of annularly spaced indexing grooves 362 defined in the section 364 (see FIG. 3A) of the spindle 128 adjacent face 118 of headstock 18. These grooves 362 are adapted for receiving the end portion 366 of a rotatably mounted indexing dog 368 secured at one of its end to the headstock face 118 at a location spaced from the spindle 128 by a suitable screw or the like (See FIG. 1). The rotational position of the spindle and workpiece 12 can be indexed to a predetermined position by moving the end portion 366 of the dog 368 into a predetermined groove. It will be recognized that the motor 154 is de-energized during such indexing operations. Moreover, lathe dog post 144 and cooperating post 140 mounted on spindle 112 are preferably secured together by a suitable bracket (not shown) to prevent movement of the workpiece 12 from its indexed position during machining.

In certain applications, it is desirable that the contoured surface of the workpiece 12 incorporates symmetry held within stringent tolerances. To this end, contact means 28 is fabricated from an elongated block 370 (See FIGS. 6A and 6B) having a bifurcated surface 372 (exaggerated for purposes of illustration) with a first section 374 which is slightly relieved or elevated relative to the adjacent section 376. The elevated section 374 of the surface extends substantially along the length of the block 370 and serves to guide the abrasive belt 22 along a predetermined path adapted for imparting a desired contour along one portion (normally one end portion) of the guage length.

During machining of the final finish on a section of a workpiece adjacent section 374 of the block 370, section 376 of the surface 372 serves to remove a portion of the stock an adjacent length of workpiece. The block 370 is then removed from the mounting block 310 rotated 180° about its longitudinal axis and again secured to the mounting block 310 as shown in FIG. 6B. In this connection, the belt 22 is guided over as identical portion of the block surface 372, i.e., section 374, to produce the necessary or desired symmetry in the gauge length when the belt is moved into contact with the workpiece 12.

Figure 6A:
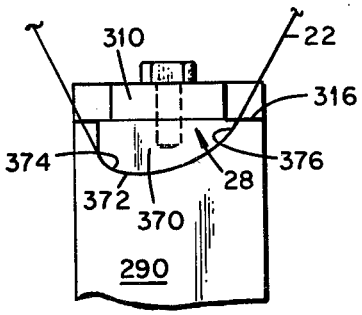
FIGS. 6A and 6B are partial plan views of the apparatus shown in FIG. 2 showing alternate contact means.
Figure 6B:
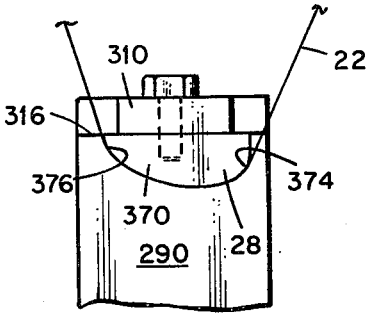

In operations employing block 370 as shown in FIGS. 6A and 6B, the taper of the contour of the guage length is selectively adjustable by rotating the workpiece relative to the contact means. To this end, way 16 can be pivoted about its end 375 (see FIGS. 1 and 2) secured by tie down 68 to rotate the workpiece with respect to the contact means 28. In this connection, a pair of vertical frame members 377 and 379 are secured to opposite sides of frame member 48 adjacent end 380 of way 16 along their respective lower edges by welding, for example, and carry adjusting screws 382 and 384, respectively, threadably received in bores therein. The outboard ends of these screws 382 and 384, respectively, abut opposite sides of the way 16 to pivot it together with the workpiece about end 375 of the way to adjust the taper of the machined coutour. The position of the way end 380 is indicated by a dial micrometer 386 carried by frame member 376 and including an arm 388 which engages the side 390 of the way for sensing its position.

In operation, the workpiece is supportably engaged at its opposite end by cooperating centers which position the workpiece along a predetermined axis which is substantially horizontal in the illustrated embodiment. The centers are fabricated from carbide in one embodiment to assist in retarding wear that may be attended by undesirable movement of the workpiece along its axis. Moreover, the dead centers, i.e. centers which do not rotate or move relative to the frame during machining operations are provided. Utilization of dead centers assists in preventing damage to a specimen or workpiece 12 in the event a spindle bearing, for example, wears out.

Contact means which serves to guide the belt along a predetermined path is advanced toward the workpiece along a path substantially perpendicular to the axis of the workpiece to bring the abrasive belt and workpiece into contact. The distance travelled by the contact means and its contoured surface over which the abrasive belt travels is controlled withing a high degree of accuracy by operation of the lathe compound handle which rotates the lathe dial and serves to provide an indication of the distance travelled by the contact means. In this connection, the amount of stock removed can be controlled by the operator and the operator can gradually remove stock from the guage means until a guage length having a desired contour and depth is attained. It will be recognized that during operations in which the workpiece is rotated the amount of stock removed will be twice the movement of the contact means 28 indicated.

The contour of the guage length is controlled by the shape of the contoured surface of the contact means which serves to guide the abrasive belt along a predetermined path for producing a desired contour in the workpiece. In one embodiment, the contact means comprises an elongated contoured block which is adjustable vertically with respect to the axis of the workpiece for exposing different sections of the contoured surface of the block to the belt to the end that a fresh section of the contoured surface of the block may be exposed to the belt subsequent to wearing or scarring of a portion of the block section serving to guide the belt.

Moreover, the workpiece can be rotated during machining operations to produce a contoured surface having a substantially circular outline. In this connection, the speed at which the workpiece is rotated and the speed at which the abrasive belt 22 is driven can be adjusted to control the helical pitch of the marks extending substantially longitudinally of the workpiece. As necessary or desired, the workpiece can be maintained in predetermined indexed positions for producing a workpiece having an outline of a predetermined geometric shape.

From the foregoing detailed description, it will be recognized that the present abrasive belt method apparatus enables a semi-skilled machinist to produce a contoured workpiece or a specimen within close tolerances. Moreover, the contoured surface can readily be repeated on different workpieces fabricated from various metals and/or alloys, and as necessary or desired, alternate contact means can be substituted for guiding the belt along various predetermined paths for producing preselected contours.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. An abrasive belt apparatus adapted for machining a workpiece comprising: a frame, means mounted on said frame for positioning said workpiece along a predetermined axis; endless abrasive belt means disposed in a plane substantially aligned with the axis of the workpiece, means engaging said belt means for driving said abrasive belt means; contact means defining a precisely machined contoured face which engages a section of said abrasive belt means for guiding said belt means along a predetermined path, means mounted on said frame for supportably engaging said contact means, means for moving said contact means along an axis substantially perpendicular to said axis along which said workpiece is positioned, said means for moving said contact means including means for precisely controlling the position of said contact means whereby a preselected contour and finish is produced by movement of said contact means to bring said abrasive belt into contact with said workpiece said means for precisely moving said contact means serving to advance said contact means towards the axis of said workpiece, thereby imparting the contour of said contact means face into said workpiece as stock is removed from said workpiece such that the finished workpiece incorporates a surface having a preselected contour which is substantially identical to the contoured face of said contact means.

2. The apparatus of claim 1 wherein said means mounted on said frame for positioning said workpiece along a predetermined axis comprises way means, headstock means slidably supported on said way means for longitudinal movement therealong, a first center mounted on said headstock means and disposed along an axis substantially parallel to the longitudinal axis of said way means, said first center adapted for supportably engaging one end of said workpiece, tailstock means slidably supported on said way means for longitudinal movement therealong, a further center mounted on said tailstock and disposed in substantial alignment with the axis of said first center, said further center being adapted for supportably engaging the opposite end of said workpiece.

3. The apparatus of claim 1 including means for rotating said workpiece during machining operations.

4. The apparatus of claim 1 wherein said contact means comprises an elongated block defining a contoured surface about which said endless belt means is trained, whereby said belt means is guided along a predetermined path for machining a desired contour in said workpiece.

5. The apparatus of claim 1 wherein said means mounted on said frame for supportably engaging said contact means and for moving said contact means comprises a lathe compound assembly including a base section secured to said frame, an upper section slidably mounted on said base section and selectively movable along a predetermined path, and a connecting arm secured at one of its ends to said upper section of said lathe compound and supportably engaging said contact means at its opposite end.

6. The apparatus of claim 1 including means for rotatably indexing the workpiece to a predetermined rotational position prior to the removal of stock from said workpiece by driving said belt whereby a workpiece having a guage length cross section with a plurality of substantially flat edges can be produced.

7. The apparatus of claim 2 wherein said further center is mounted in a carriage slidably supported on said tailstock means, said carriage being spring biased toward said first center to facilitate removal and insertion of said workpiece.

8. The apparatus of claim 2 including means for controlling the position of said headstock means on said way means and means for indicating the position of said headstock means on said way means.

9. The apparatus of claim 2 including means for controlling the position of said tailstock means on said way means and means for indicating the position of said tailstock means on said way means.

10. The apparatus of claim 2 including means for locking said headstock means into a preselected position on said way means.

11. The apparatus of claim 2 including means for locking said tailstock means into position on said way means.

12. The apparatus of claim 1 including means for rotating the longitudinal axis of said workpiece with respect to the axis along which said contact means is moved towards said workpiece such that said workpiece can be tilted with respect to said contact means during the machining operation.

13. The apparatus of claim 2 including means for rotating said way means on said frame whereby said axis of said workpiece can be rotated with respect to the axis along which said precisely ground contoured face of said contact means is advanced towards said workpiece during machining operations.

14. The apparatus of claim 1 wherein said contoured face of said contact means is elongated and including means for adjusting the vertical position of said contact means for exposing a fresh section of said elongated face to said belt means whereby the number of substantially identical specimens ground from workpieces using a single contact means can be increased.

15. The apparatus of claim 1 wherein said means for supportably engaging said contact means includes a reference surface which assists in positioning a freshly ground contact means at a predetermined location such that the contour in subsequently machined workpieces will be substantially identical.

16. The apparatus of claim 1 wherein said contact means comprises a block having a bifurcated surface with a first and further section, said first section being elevated with respect to said further section.

17. An abrasive belt apparatus adapted for machining an elongated workpiece having opposite ends comprising; a frame, a lathe way mounted on said frame, headstock means slidably supported on said way for longitudinal movement therealong, a first center mounted on said headstock means and disposed along an axis substantially parallel to the longitudinal axis of said way, said first center adapted for supportably and rotatably engaging one end of said workpiece, tailstock means slidably supported on said way for longitudinal movement therealong, a further center mounted on said tailstock and disposed in substantial axial alignment with said first center, said further center being adapted for supportably and rotatably engaging the opposite end of said workpiece, an endless abrasive belt means disposed in a plane substantially aligned with the longitudinal axis of said workpiece said axis being defined by supporting said workpiece at its opposite ends with said first and further centers, a motor for driving said abrasive belt means, contact means engaging a section of said abrasive belt means for guiding said belt means along a predetermined path defined by a precisely machined contoured face, means mounted on said frame for supportably engaging said contact means, and means for moving said contact means along an axis substantially perpendicular to said axis along which said workpiece is positioned, said means for moving said contact means including means for precisely controlling the position of said contact means, whereby a preselected contour and finish is produced by movement of said contact means to bring said abrasive belt into contact with said workpiece said means for precisely moving said contact means serving to advance said contact means towards the axis of said workpiece, thereby imparting the contour of said contact means face into said workpiece as stock is removed from said workpiece such that the finished workpiece incorporates a surface having a preselected contour which is substantially identical to the contoured face of said contact means.

* * * * *